US008801495B1

(12) United States Patent
Guindon

(10) Patent No.: US 8,801,495 B1
(45) Date of Patent: Aug. 12, 2014

(54) BRA WITH BREAST PUMPING APPARATUS INTEGRATED THEREIN

(76) Inventor: Desirae A. Guindon, Spokane, WA (US)

( * ) Notice: Subject to any disclaimer, the term of this patent is extended or adjusted under 35 U.S.C. 154(b) by 147 days.

(21) Appl. No.: 13/591,841

(22) Filed: Aug. 22, 2012

Related U.S. Application Data

(60) Provisional application No. 61/527,670, filed on Aug. 26, 2011.

(51) Int. Cl.
*A41C 3/00* (2006.01)

(52) U.S. Cl.
USPC ..... 450/36; 450/38; 604/74; 604/73

(58) Field of Classification Search
USPC ..... 450/38, 36, 89, 1; 604/73, 74
See application file for complete search history.

(56) References Cited

U.S. PATENT DOCUMENTS 5,514,166 A * 5/1996 Silver et al. ..... 604/74
5,575,768 A * 11/1996 Lockridge et al. ..... 604/74
6,354,906 B1 * 3/2002 Liu ..... 450/38
6,440,100 B1 * 8/2002 Prentiss ..... 604/74
7,559,915 B2 * 7/2009 Dao et al. ..... 604/74
7,607,965 B1 * 10/2009 Frazier ..... 450/36
8,118,772 B2 * 2/2012 Dao et al. ..... 604/74
8,142,393 B2 * 3/2012 Myers ..... 604/74
2003/0191433 A1 * 10/2003 Prentiss ..... 604/74
2008/0208116 A1 * 8/2008 Dao et al. ..... 604/74
2008/0262420 A1 * 10/2008 Dao et al. ..... 604/74
2009/0156993 A1 * 6/2009 Callanan et al. ..... 604/74
2013/0232661 A1 * 9/2013 Huntley ..... 2/104

* cited by examiner

*Primary Examiner* — Gloria Hale
(74) *Attorney, Agent, or Firm* — Kyle A. Fletcher, Esq.

(57) ABSTRACT

The bra with breast pumping apparatus integrated therein includes a breast-shaped cup that a breast milk pump adjacent a nipple of an end user. The bra is adapted to be worn while simultaneously pumping breast milk from the nipple of the end user, and which transfers said breast milk into a fill bag that is held in place against the breast-shaped cup via a pocket. Once the fill bag is filled, the end user can remove the fill bag from the bra without requiring removal of the bra altogether. A powering member is integrated elsewhere on said bra, and provides the power necessary to run the breast milk pump.

18 Claims, 4 Drawing Sheets

BRA WITH BREAST PUMPING APPARATUS INTEGRATED THEREIN

CROSS REFERENCES TO RELATED APPLICATIONS

This non-provisional patent application claims priority to provisional patent application 61/527,670, which was filed on Aug. 26, 2011.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of breast pumps, more specifically, a bra that includes a breast pump integrated into the construction of said bra.

Breastfeeding and breast pumps are vitally important to provide the nutrition necessary of a new born. A breast pump can be a laborious process that requires exposing a breast from a blouse or other garment in order to connect up to the breast pump. What is needed is a brassiere that is specifically adapted to support the breast while also integrating a breast pump into the construction such that when the brassiere is being worn, the end user can be pumping breast milk as needed. What is more needed, is a brassiere that includes fill bags and pouches for storage of said fill bags such that when the fill bag is filled up, the end user can simply remove the fill bag from the brassiere without having to remove the brassiere.

B. Discussion of the Prior Art

As a preliminary note, it should be stated that there is an ample amount of prior art that deals with breast pumps, generally speaking. As will be discussed immediately below, no prior art discloses a bra that includes a breast-shaped cup therein into which a breast pump is integrated; wherein the breast pump is in fluid communication with a fill bag that is located in a pocket located elsewhere with respect to the breast-shaped cup; wherein a powering member is in wired communication with said breast pump, and which powers the breast pump in order to extract breast milk from a nipple placed in the breast-shaped cup and in close proximity with the breast pump; wherein the fill bag is able to be extracted from the pocket, and emptied for use in feeding of a newborn whilst said bra remains on the end user; wherein the bra supports the breast-shaped cup, breast pump, and fill bag.

The Lundy Patent (U.S. Pat. No. 6,379,327) discloses a portable breast pump system that includes a breast receptor for receiving a breast, a vacuum suction compartment connected to the breast receptor and a collection container for receiving breast milk. Firstly, the system includes a body strap to aid in support of componentry associated with the breast pump, and is not entirely supported on the bra alone.

The Dao et al. Patent (U.S. Pat. No. 7,559,915) discloses a compact and hands-free human breast milk collection device that fits into a mother's existing nursing or standard brassierre, or in another embodiment includes a complete brassiere and milk collection system. However, the device does not place a fill bag on a pocket located elsewhere with respect to a breast-shaped cup that also supports the breast pump thereon.

The Hall Patent (U.S. Pat. No. 7,833,190) discloses a breast pump including a cylindrical housing encapsulated by an insulated thermal layer. Again, the breast pump does not connect to a fill bag in close proximity thereof.

The Francis Patent (U.S. Pat. No. 6,821,185) discloses a bra for use while pumping breast milk, which includes a slot in the breast section of the bra for use with a breast pump funnel and a padded area surrounding each slot to support the funnel. However, the bra does not include the breast-shaped cup that supports a breast milk pump and pouch or pocket for securing a fill bag thereto.

The Whitehead et al. Patent Application Publication (U.S. Pub. No. 2007/0161330) discloses a hands-free breast pump bra comprising a side bra opening with a circular opening at the center for easily inserting and securing the suction cup in place while also supporting a woman's breast. Aside from a bulky breast milk pump being attached outwardly from the nipple, the bra does not teach a breast-shaped cup that supports a fill bag via a pouch and adjacent to a thin-profiled breast milk pump.

The Logan Patent (U.S. Pat. No. 6,887,217) discloses a device for expressing milk using a maternity brassier modified to accept a funnel shaped vacuum cup attached to a breast milk pump. Again, the device does not teach a breast-shaped cup that fits in between the bra and breast of an end user, and which supports a thin-profiled breast milk pump adjacent to a nipple. Moreover, the device of Logan fails to teach a fill bag held relatively close to the nipple and breast milk pump, and via a pouch located on an outer surface of the breast-shaped cup.

While the above-described devices fulfill their respective and particular objects and requirements, they do not describe a bra that includes a breast-shaped cup therein into which a breast pump is integrated; wherein the breast pump is in fluid communication with a fill bag that is located in a pocket located elsewhere with respect to the breast-shaped cup; wherein the breast milk pump is comprised of a series of components that when assembled has a relatively thin-profile so as to not be too protrusive from the breast portion of the bra; wherein the breast milk pump attaches to the fill bag directly, which is held adjacent to the breast-shaped cup via the pocket, which is relatively close to the skin of the breast thereby keeping the breast milk at body temperature; wherein a powering member is in wired communication with said breast pump, and which powers the breast pump in order to extract breast milk from a nipple placed in the breast-shaped cup and in close proximity with the breast pump; wherein the fill bag is able to be extracted from the pocket, and emptied for use in feeding of a newborn whilst said bra remains on the end user; wherein the bra supports the breast-shaped cup, breast pump, and fill bag. In this regard, the bra with breast pumping apparatus integrated therein departs from the conventional concepts and designs of the prior art.

SUMMARY OF THE INVENTION

The bra with breast pumping apparatus integrated therein includes a breast-shaped cup that a breast milk pump adjacent a nipple of an end user. The bra is adapted to be worn while simultaneously pumping breast milk from the nipple of the end user, and which transfers said breast milk into a fill bag that is held in place against the breast-shaped cup via a pocket. Once the fill bag is filled, the end user can remove the fill bag from the bra without requiring removal of the bra altogether.

A powering member is integrated elsewhere on said bra, and provides the power necessary to run the breast milk pump.

An object of the invention is to provide a bra that includes a breast-shaped cup that is specifically adapted to be worn between a bra and the breast directly, and which is uniquely adapted to pump breast milk directly from the nipple whilst the bra is being worn on the end user.

A further object of the invention is to provide a breast-shaped cup that supports a breast milk pump on a distal end, and from which a fill bag attaches and is supported in a pocket elsewhere on the breast-shaped cup.

An further object of the invention is to provide a breast milk pump comprised of a series of components that when installed shall produce a thin-profile.

An even further object of the invention is to include a suction cup that is mounted to an inner surface of the breast-shaped cup, and which includes a connection port that traverses through the breast-shaped cup, and whereby the breast milk pump connects thereon.

A further object of the invention is to include a powering member from which wiring extends around a strap member of said bra to the breast milk pump thereby powering said breast milk pump.

Another object of the invention is to include a pocket on an exterior surface of the breast-shaped cup, which holds the fill bag in relative proximity of the nipple and the breast milk pump.

An even further object of the invention is to locate the fill bag close to the breast of the end user, which enables body heat to maintain body temperature to the breast milk in the fill bag.

An even further object of the invention is to enable the fill bag to be disconnected from the breast milk pump, removed from the pocket of the breast-shaped cup, and altogether removed from the invention without requiring the bra to be taken off of the end user.

Another object of the invention is to enable the breast-shaped cup to be removed from inside of the bra in order to switch breasts or to be removed altogether when in between use.

These together with additional objects, features and advantages of the bra with breast pumping apparatus integrated therein will be readily apparent to those of ordinary skill in the art upon reading the following detailed description of presently preferred, but nonetheless illustrative, embodiments of the bra with breast pumping apparatus integrated therein when taken in conjunction with the accompanying drawings.

In this respect, before explaining the current embodiments of the bra with breast pumping apparatus integrated therein in detail, it is to be understood that the bra with breast pumping apparatus integrated therein is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bra with breast pumping apparatus integrated therein.

It is therefore important that the claims be regarded as including such equivalent construction insofar as they do not depart from the spirit and scope of the bra with breast pumping apparatus integrated therein. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
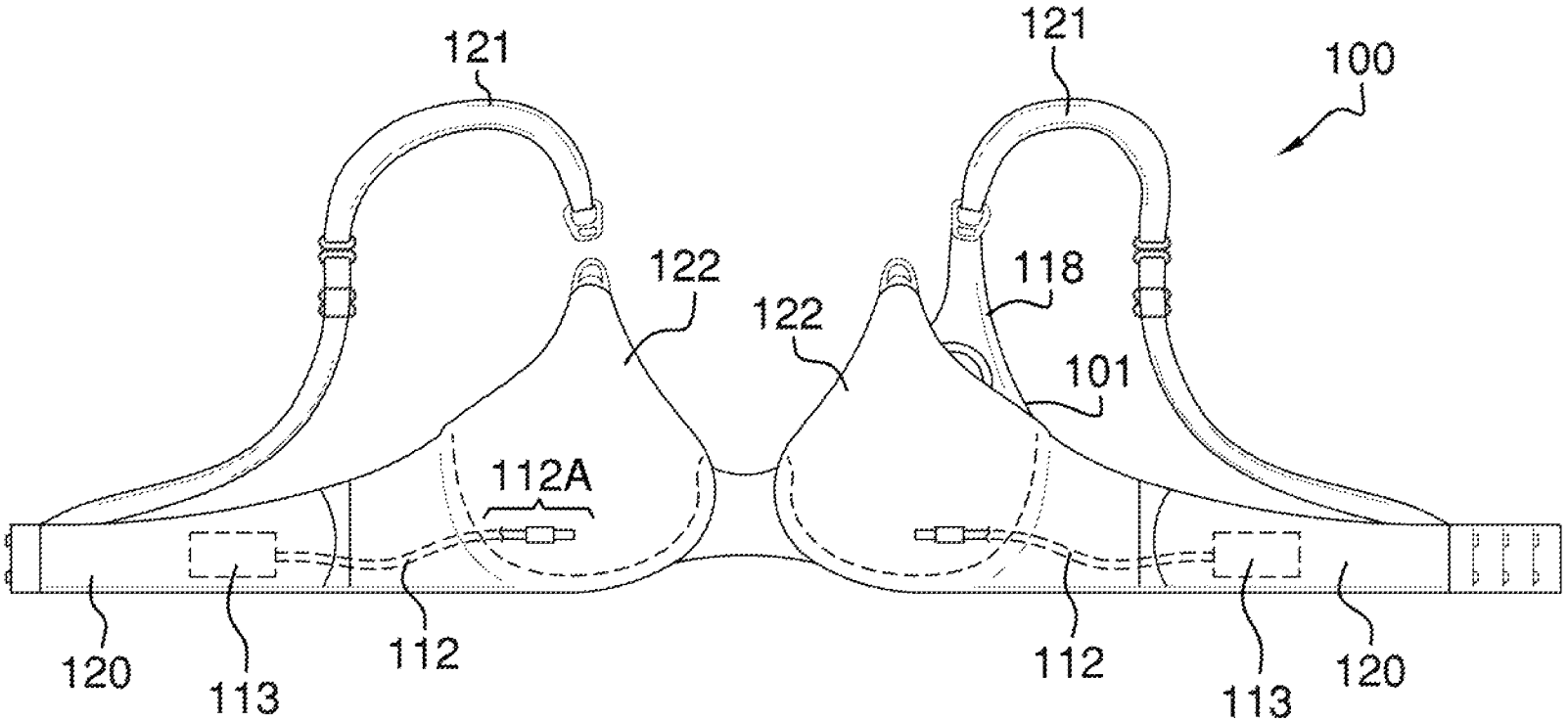
FIG. 1 illustrates a front view of the bra with breast pumping apparatus integrated therein by itself and depicting the wiring and powering members integrated into the strap portion of the bra.
Figure 2:
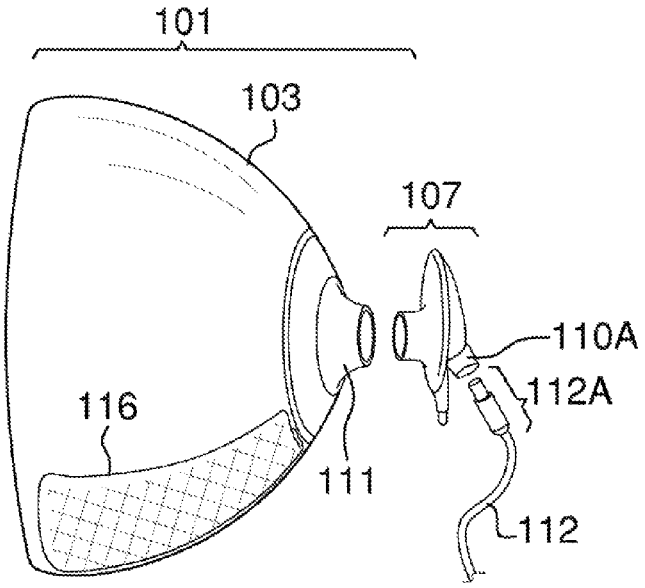
FIG. 2 illustrates a detailed side view of the breast-shaped cup with the breast milk pump aligned adjacent to the connection port of the suction cup, as well as the wiring extending to the breast milk pump.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A bra with breast pumping apparatus integrated therein 100 (hereinafter invention) includes a breast-shaped cup 101 that has a shape specifically designed to contour to a breast 130 of an end user 131. The breast-shaped cup 101 is further defined as including an inner surface 102 and an outer surface 103. The breast-shaped cup 101 is a thin-profiled component of the invention 100, and thus has a thin-walled construction so as to prevent a bulky invention 100 when in use.

The breast-shaped cup 101 is further defined with a distal end 104 that includes a port hole 105 through which a suction cup 106 is able to connect with a breast milk pump 107. The suction cup 106 is placed adjacent to a nipple 132 of the end user 130, and derives breast milk therefrom, via the breast milk pump 107. The breast milk pump 107 is comprised of several components that when assembled form a relatively thin profile so as to minimize bulkiness of the invention 100.

Figure 3:
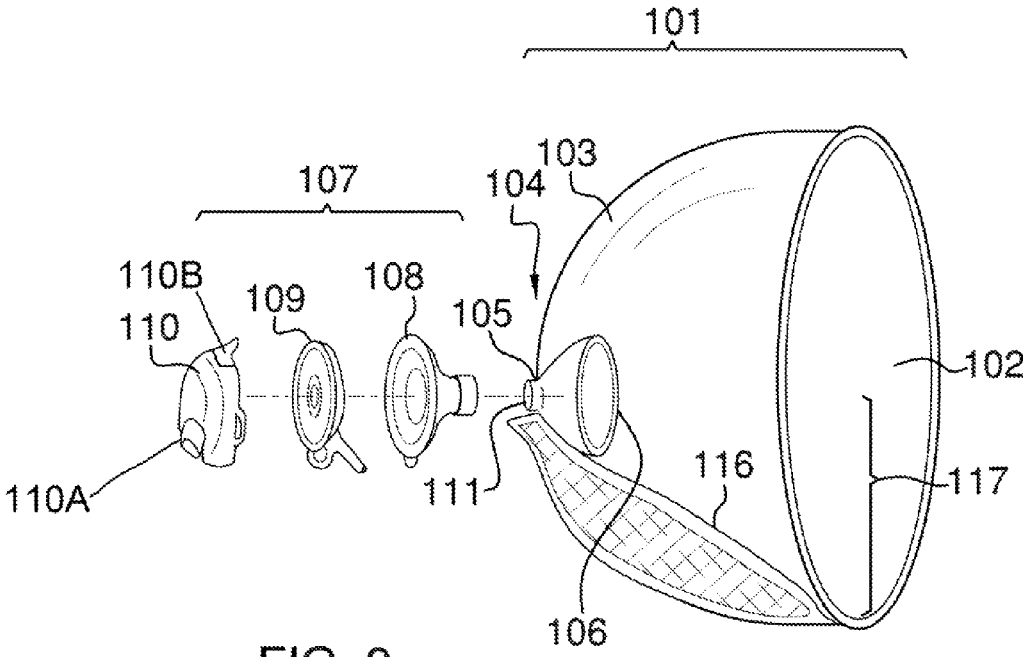
FIG. 3 illustrates an exploded view of the components comprising the breast milk pump, suction cup, and breast-shaped cup.
Figure 4:
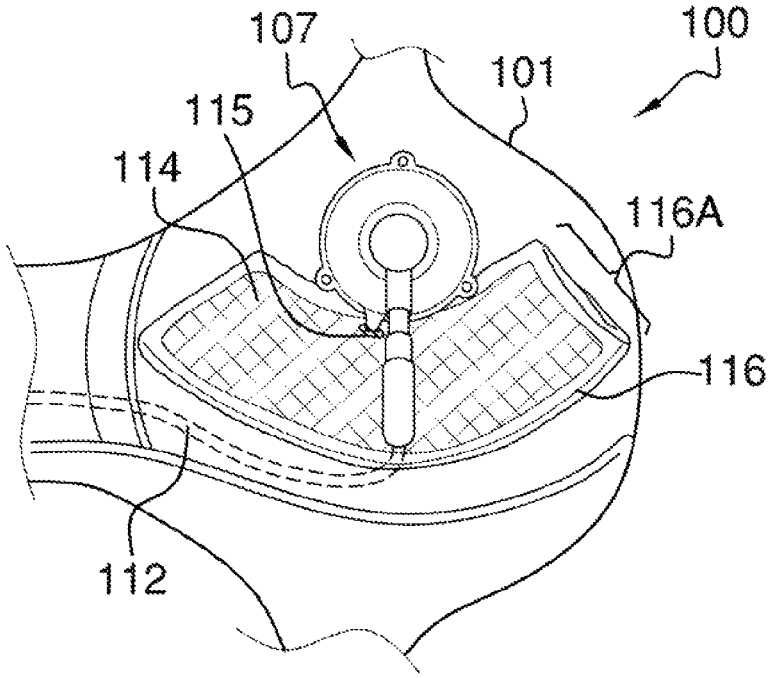
FIG. 4 illustrates a front view of the breast-shaped cup with the breast milk pump assembled and attached to the connection port of the suction cup, and further depicting fluid communication between the breast milk pump and fill bag being stored in the pocket on the exterior of the breast-shaped cup.
Figure 5:
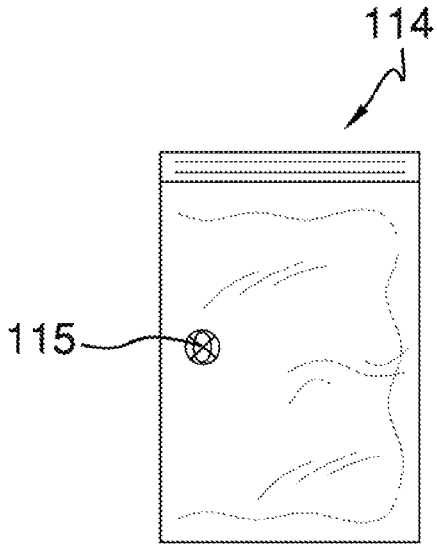
FIG. 5 illustrates a front view of the fill bag by itself and detailing the one-way valve that enables fluid communication with the breast milk pump.
Figure 6:
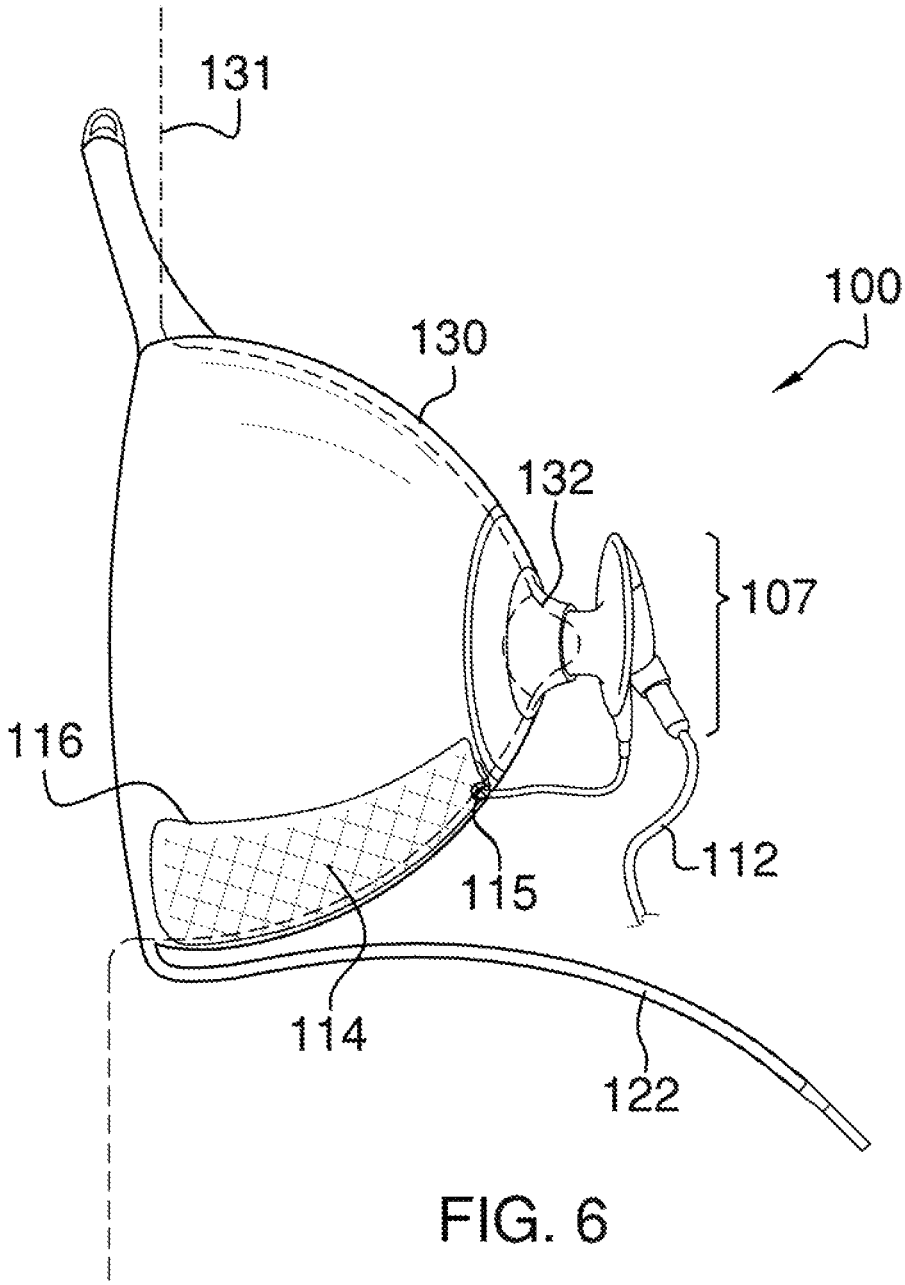
FIG. 6 illustrates a detailed view of the bra with breast pumping apparatus integrated therein in use with a breast and nipple.

Referring to FIG. 3, the breast milk pump 107 is comprised of a pump back 108, a dispenser nozzle 109, and a pumping member 110. The pump back 108 connects directly to the suction cup 106, which includes a connection port 111. The pump back 108 and the pumping member 110 sandwich the dispenser nozzle 109 there between. The breast milk pump 107 is able to attached to and removed from the suction cup 106 as needed. Moreover, the breast milk pump 107 may be removed from the invention 100 between uses or remain in place with the bra being worn in a traditional manner, which is possible via the thin profile of the breast milk pump 107.

The pumping member 110 connects to a wiring member 112 that spans across a bra strap 120 to a powering member 113 located elsewhere with respect to the invention 100. The dispenser nozzle 109 connects to a fill bag 114 that includes a one-way valve 115 such that breast milk is pumped into the fill bag 114, and is unable to exit back through the one-way valve 115. The fill bag 114 is of no specific volume, but is made of a flexible material, such as plastic. The fill bag 114 is a unique component of the invention 100 in that the fill bag 114 connects directly to the breast milk pump 107, and is relatively close to the breast 130.

The breast-shaped cup 101 includes a pocket 116 that is provided on a bottom half 117 of the outer surface 103. The pocket 116 may also be referred to as a pouch, and is possibly constructed of a netting so as to minimize overall weight, and while providing flexibility. The pocket 116 includes an opening 116A, which enables the fill bag 114 to be inserted and removed between fillings.

The breast-shaped cup 101 includes a cup strap member 118 that extends upwardly to enable connection with a second bra strap 121. It shall be noted that the invention 100 includes bra cup members 122 that connect to both the bra strap 120 and second bra strap 121, and in a manner consistent with a traditional brassiere. Moreover, the cup strap member 118 and the bra cup members 122 may both or individually connect with the cup strap member 118.

It shall be noted that both bra straps 120 may include powering members 113 and their respective wiring 112 to provide power to the breast milk pump 107 being located on either or both sides of the invention 100. That being said, the invention 100 may be equipped with at least one if not two breast milk pumps 107 such that both breasts 130 of the end user 131 can be pumped simultaneously or in an alternating fashion.

It shall be duly noted that the wiring 112 may require the use of a connector member 112A at a distal end, which enables the pumping member 110 to be plugged into the powering member 113. Moreover, the pumping member 110 may include a plug port 110A, which enables the connector member 112A to plug or unplug there from as needed.

It shall be noted that the pumping member 110 may include a vibrator member 110B integrated therein, and which is used to generate a vibrating sensation for the sole benefit of formulating an alarm to an end user. The vibrator member 110B shall create a pulsating or vibrating sensation that when in use with the pumping member 110 shall alert an end user to the fact that the fill bag 114 is full, and needs to be replaced. The vibrator member 110B is in wired communication with the pumping member 110, and shall turn on when the pressure generated upon pumping the breast milk becomes elevation, which is due to the fill bag 114 being full. It shall be noted that the vibrating member 110B may turn itself on once the fill bag 114 reaches capacity, and after which the one-way valve 115 prevents freshly pumped breast milk from entering into the fill bag 114.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A bra with breast pumping apparatus integrated therein comprising:

at least one breast-shaped cup onto which a breast milk pump is selectively attached and configured for placement against a nipple of a breast of an end user in order to pump breast milk therefrom, and which said breast milk is pumped into a fill bag located elsewhere with respect to said breast-shaped cup;

wherein bra cups are adapted for placement over said breast-shaped cups, and which is worn in a bra;

wherein said breast-shaped cups are placed against said bra cups of said bra;

wherein said breast-shaped cups are configured for placement directly against the nipple of the breast of an end user such that the breast-shaped cups are sandwiched between the bra cups of the bra and the breast of the end user;

wherein the breast-shaped cup is further defined as including an inner surface and an outer surface; wherein the breast-shaped cup is further defined with a distal end that includes a port hole;

wherein the breast milk pump connects with a suction cup that includes a connection port that passes through the port hole of the breast-shaped cup; wherein the suction cup is placed against to said nipple of said end user.

2. The bra with breast pumping apparatus integrated therein as described in claim 1 wherein the breast milk pump is further comprised of a pump back, a dispenser nozzle, and a pumping member.

3. The bra with breast pumping apparatus integrated therein as described in claim 2 wherein the pump back and the pumping member sandwich the dispenser nozzle there and between; wherein the breast milk pump is capable of attachment and removal from the suction cup as needed.

4. The bra with breast pumping apparatus integrated therein as described in claim 3 wherein the pumping member connects to a wiring member that spans across a bra strap to a powering member located elsewhere with respect to the bra.

5. The bra with breast pumping apparatus integrated therein as described in claim 4 wherein the dispenser nozzle connects to the fill bag, and which includes a one-way valve; wherein the pumping member includes a vibrator member, which generates a vibrating sensation indicating that the fill bag is full, and needs to be replaced.

6. The bra with breast pumping apparatus integrated therein as described in claim 5 wherein the breast-shaped cup includes a pocket that is provided on a bottom half of the outer surface of the breast-shaped cup.

7. The bra with breast pumping apparatus integrated therein as described in claim 6 wherein the pocket includes an opening, which enables the fill bag to be inserted and removed between fillings.

8. The bra with breast pumping apparatus integrated therein as described in claim 7 wherein the breast-shaped cup includes a cup strap member that extends upwardly to enable connection with a second bra strap.

9. The bra with breast pumping apparatus integrated therein as described in claim 8 wherein bra cup members connect to both the first bra strap and second bra strap; wherein the cup strap member and the bra cup members both or individually connect with the cup strap member.

10. The bra with breast pumping apparatus integrated therein as described in claim 9 wherein both bra straps include powering members and their respective wiring to provide power to the breast milk pump being located on either or both sides of the bra.

11. The bra with breast pumping apparatus integrated therein as described in claim 4 wherein the wiring includes a connector member at a distal end, which enables the pumping member to be plugged into the powering member; wherein the pumping member include a plug port, which enables the connector member to plug or unplug there from as needed.

12. A bra with breast pumping apparatus integrated therein comprising:

at least one breast-shaped cup onto which a breast milk pump is selectively attached and configured for placement against a nipple of a breast of an end user in order to pump breast milk therefrom, and which said breast milk is pumped into a fill bag located elsewhere with respect to said breast-shaped cup;

wherein bra cups are adapted for placement over said breast-shaped cups, and which is worn in a bra;

wherein said breast-shaped cups are placed against said bra cups of said bra;

wherein said breast-shaped cups are configured for placement directly against the nipple of the breast of an end user such that the breast-shaped cups are sandwiched between the bra cups of the bra and the breast of the end user;

wherein the breast milk pump is further comprised of a pump back, a dispenser nozzle, and a pumping member;

wherein the dispenser nozzle connects to the fill bag, and which includes a one-way valve.

13. The bra with breast pumping apparatus integrated therein as described in claim 12 wherein the breast-shaped cup is further defined as including an inner surface and an outer surface; wherein the breast-shaped cup is further defined with a distal end that includes a port hole; wherein the breast milk pump connects with a suction cup that includes a connection port that passes through the port hole of the breast-shaped cup; wherein the suction cup is placed against to said nipple of said end user.

14. The bra with breast pumping apparatus integrated therein as described in claim 13 wherein the pump back and the pumping member sandwich the dispenser nozzle there and between; wherein the breast milk pump is capable of attachment and removal from the suction cup as needed; wherein the pumping member connects to a wiring member that spans across a bra strap to a powering member located elsewhere with respect to the bra; wherein the wiring includes a connector member at a distal end, which enables the pumping member to be plugged into the powering member; wherein the pumping member include a plug port, which enables the connector member to plug or unplug there from as needed; wherein the pumping member includes a vibrator member, which generates a vibrating sensation indicating that the fill bag is full, and needs to be replaced.

15. The bra with breast pumping apparatus integrated therein as described in claim 14 wherein the breast-shaped cup includes a pocket that is provided on a bottom half of the outer surface of the breast-shaped cup; wherein the pocket includes an opening, which enables the fill bag to be inserted and removed between fillings.

16. The bra with breast pumping apparatus integrated therein as described in claim 15 wherein the breast-shaped cup includes a cup strap member that extends upwardly to enable connection with a second bra strap.

17. The bra with breast pumping apparatus integrated therein as described in claim 16 wherein bra cup members connect to both the first bra strap and second bra strap; wherein the cup strap member and the bra cup members both or individually connect with the cup strap member.

18. The bra with breast pumping apparatus integrated therein as described in claim 17 wherein both bra straps include powering members and their respective wiring to provide power to the breast milk pump being located on either or both sides of the bra.

* * * * *